US007131418B2

(12) United States Patent
Wieland

(10) Patent No.: US 7,131,418 B2
(45) Date of Patent: Nov. 7, 2006

(54) COOLED PISTON FOR AN INTERNAL COMBUSTION ENGINE

(75) Inventor: Hanspeter Wieland, Ditzingen (DE)

(73) Assignee: Mahle GmbH, Stuttgart (DE)

( * ) Notice: Subject to any disclaimer, the term of this patent is extended or adjusted under 35 U.S.C. 154(b) by 97 days.

(21) Appl. No.: 10/514,267

(22) PCT Filed: May 13, 2003

(86) PCT No.: PCT/DE03/01534

§ 371 (c)(1),
(2), (4) Date: Nov. 12, 2004

(87) PCT Pub. No.: WO03/098022

PCT Pub. Date: Nov. 27, 2003

(65) Prior Publication Data

US 2005/0211088 A1 Sep. 29, 2005

(30) Foreign Application Priority Data

May 15, 2002 (DE) ..... 102 21 561

(51) Int. Cl.
*F02F 3/22* (2006.01)

(52) U.S. Cl. ..... 123/193.6; 92/255

(58) Field of Classification Search ..... 123/193.6; 92/186, 208, 216, 255; 29/888.044, 888.045
See application file for complete search history.

(56) References Cited

U.S. PATENT DOCUMENTS 4,175,502 A 11/1979 Moebus
5,261,363 A * 11/1993 Kemnitz ..... 123/193.6
5,546,896 A * 8/1996 Zaiser ..... 123/193.6
5,778,533 A 7/1998 Kemnitz
5,778,846 A * 7/1998 Mielke ..... 123/193.6
5,845,611 A 12/1998 Schmidt et al.
6,401,595 B1 * 6/2002 Bochart ..... 92/186
6,647,861 B1 11/2003 Jacobi et al.
6,659,062 B1 * 12/2003 Issler ..... 123/193.6
6,691,666 B1 * 2/2004 Berr et al. ..... 123/193.6
6,722,263 B1 * 4/2004 Keller et al. ..... 92/186
6,938,604 B1 * 9/2005 Gabriel et al. ..... 123/193.6
6,957,638 B1 * 10/2005 Scharp ..... 123/193.6

FOREIGN PATENT DOCUMENTS

DE 27 23 619 C2 11/1978
DE 35 18 497 A 11/1986
DE 38 30 033 C2 6/1989
DE 44 46 726 A1 6/1996

(Continued)

*Primary Examiner*—Marguerite McMahon
(74) *Attorney, Agent, or Firm*—Collard & Roe, P.C.

(57) ABSTRACT

The invention relates to a cooled piston (1) for an internal combustion engine comprising a cooling duct (2). This cooling duct encircles in an annular manner inside the piston head at the height of the ring part and is closed at its end, which is open toward the piston skirt, by men of a spring part (8). Said spring part is correspondingly shaped, is radially divided at least once on the periphery thereof, and provided with a cooling oil inlet (5). The aim of the invention is to achieve an improved location-dependent removal of heat from the particularly hot portions of the piston (1). To this end, an encircling oil guiding ring (3) is placed inside the cooling duct (2) and, from the cooling oil inlet (5) to the cooling oil outlet (6), symmetrically divides the cooling duct (2) on the periphery thereof into sections (4) of different cooling duct volumes.

7 Claims, 2 Drawing Sheets

FOREIGN PATENT DOCUMENTS

| | | | |
|---|---|---|---|
| DE | 196 18 625 | | 10/1997 |
| DE | 199 26 567 | A1 | 12/2000 |
| DE | 199 26 568 | A1 | 12/2000 |
| FR | 1 244 830 | A | 10/1960 |
| JP | 56-1 24 650 | A | 9/1981 |
| WO | WO 00/77 379 | A1 | 12/2000 |

* cited by examiner

Fig. 1
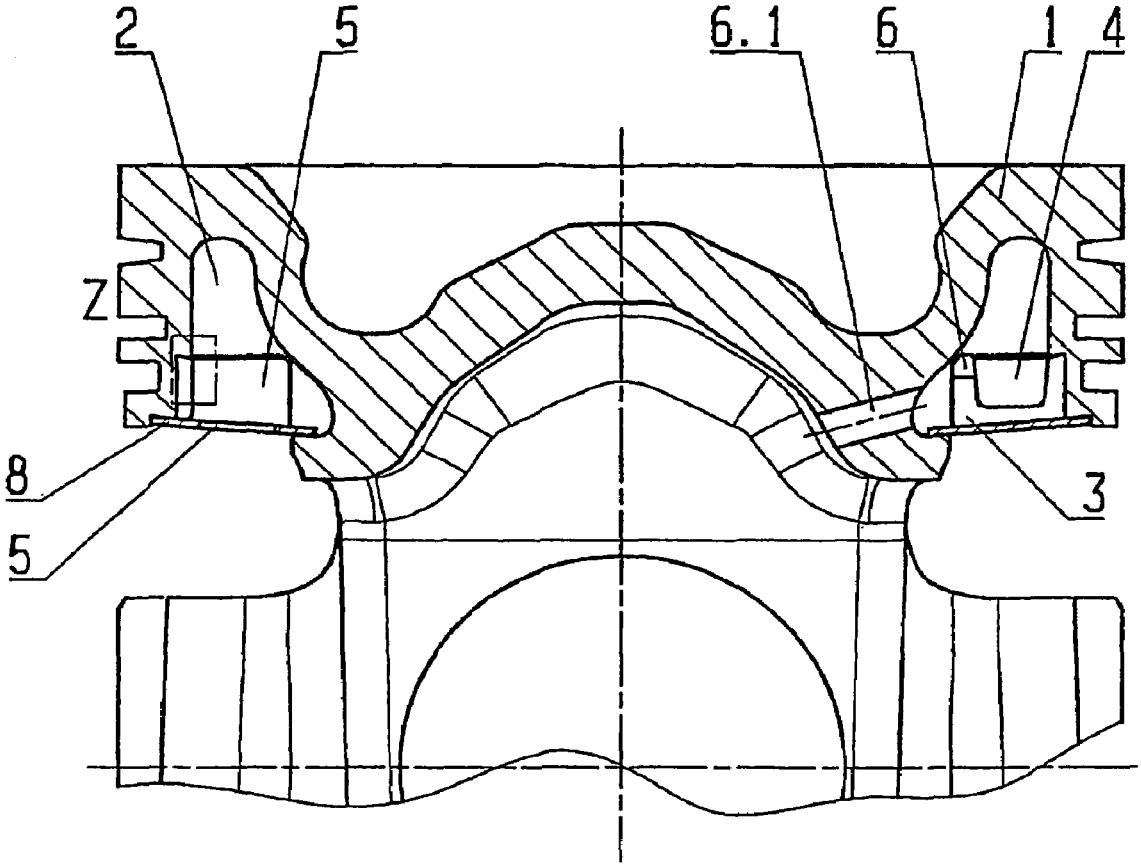
Z
10:1
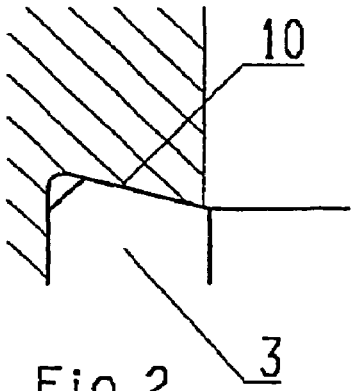
Fig. 2

Fig. 5
Developed View (180°)
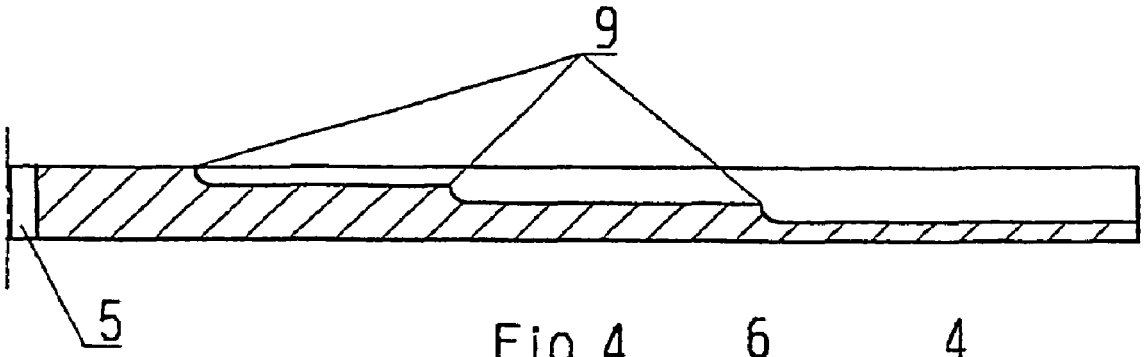
Fig. 4
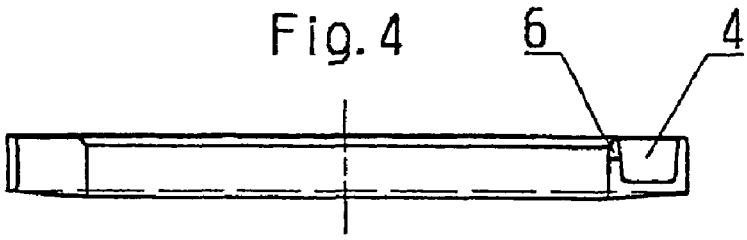
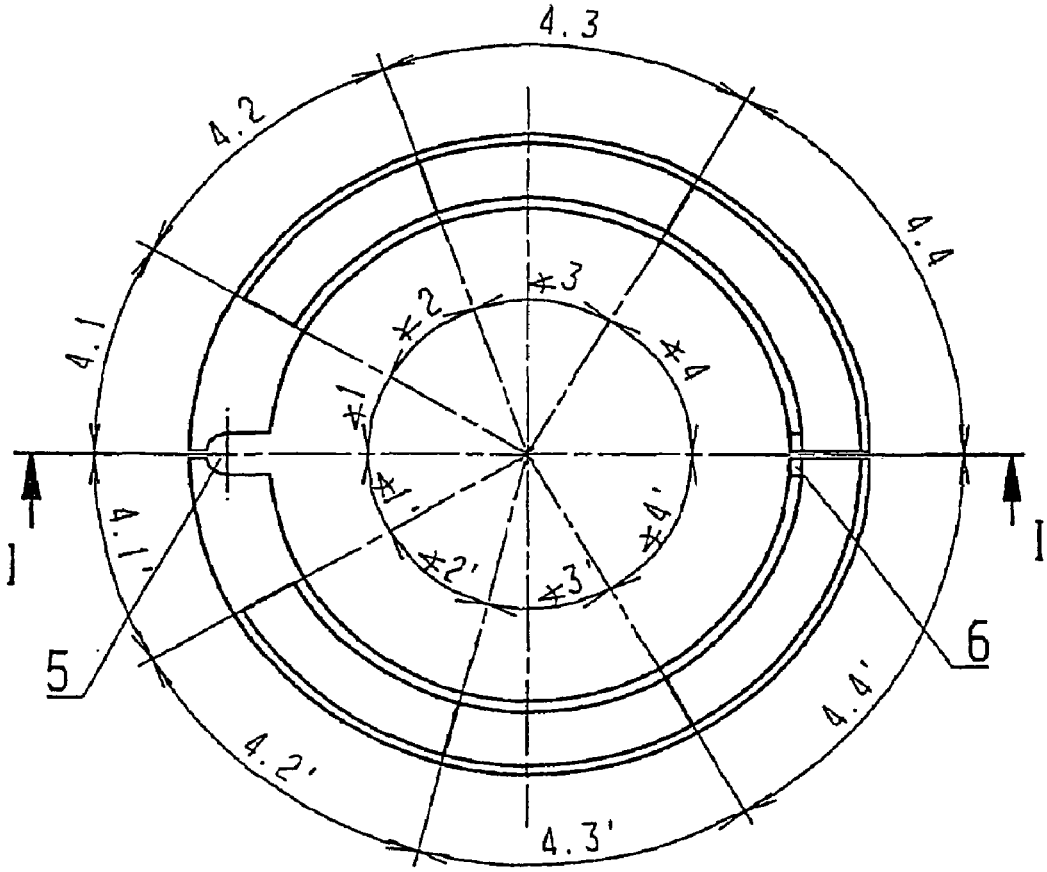
Fig. 3

COOLED PISTON FOR AN INTERNAL COMBUSTION ENGINE

CROSS REFERENCE TO RELATED APPLICATIONS

Applicant claims priority under 35 U.S.C. §119 of German Application No. 102 21 561.8 filed May 15, 2002. Applicant also claims priority under 35 U.S.C. §365 of PCT/DE03/01534 filed May 13, 2003. The international application under PCT article 21 (2) was not published in English.

The invention relates to a cooled piston for an internal combustion engine, having a combustion bowl in the piston head, and a cooling channel that runs in ring shape at the height of the ring belt, which channel is closed off, at its end that is open towards the piston skirt, by means of a wall part that is appropriately shaped and provided with a cooling oil inlet and a cooling oil outlet, and is radially divided at least once on its circumference.

Such a piston is known, for example, from DE 199 26 568 A1, in which a wall part closes off the cooling channel, whereby the wall part is provided with several radially disposed cross-walls that extend axially into the cooling channel, distributed over the circumference of the wall part, in order to improve the heat removal. In this connection, the cross-walls divide the cooling channel into shaker spaces, i.e. sections having a constant size, in order to maintain a certain level of cooling oil in the cooling channel.

Furthermore, a multi-part, liquid-cooled piston for internal combustion engines is known from DE 27 23 619 C2, which has an oil guide ring at the cooling oil inlet of its cooling channel, which ring guides the cooling oil that runs into the cooling channel, along the periphery of the cooling channel, by means of a lip.

DE 35 18 497 A1 describes a liquid-cooled piston in which a deep eccentric piston bowl can be implemented without impairing the strength of the piston. For cooling, a cooling channel is configured in such a manner that its width and depth are dependent on the distance from the piston bowl; however, the cross-sectional area of the cooling channel on the circumference side, and therefore the cooling channel volume, is constant.

It is a general disadvantage of the aforementioned embodiments that the dwell time of the cooling oil in the cooling channel has not been satisfactorily solved and that a specific heat removal from the hot piston regions into the coolant, i.e. as a function of the temperatures that occur, cannot be implemented.

It is the aim of the invention to configure a cooling channel for a piston of an internal combustion engine in such a manner that improved location-dependent heat removal from the particularly hot piston regions is achieved, so that an approximately uniform temperature distribution in the cooling channel and therefore an optimal cooling effect of the piston is guaranteed.

This aim is accomplished by means of the characteristics of claim 1.

By means of the solution according to the invention, the result is advantageously achieved that the cold cooling oil that is introduced into the cooling channel is distributed with a very small volume on a first section of an oil guide ring, as compared with the entire cooling channel volume, and therefore an intimate contact with the wall surfaces to be cooled is produced by means of the shaker effect. The amount of heat introduced into the cooling oil, i.e. the cooling of the piston, is therefore high and intensive. In order to control the amount of heat to be absorbed by the cooling oil in such a manner that as uniform as possible a temperature distribution is achieved at the ring belt of the piston, the subsequent sections of the oil guide ring increase the cooling channel volume, in each instance, according to the invention, thereby correspondingly reducing the dwell time of the cooling oil on the wall surfaces to be cooled. The great temperature difference that exists between the cooling inlet (cold cooling oil) and the cooling oil outlet (hot cooling oil) is prevented, and thereby a cause for the formation of mechanical stresses in the region of the combustion chamber of the piston is also prevented.

Further advantageous embodiments are the object of the dependent claims.

The invention will be explained in greater detail below, using an exemplary embodiment. The drawing shows:

FIG. 1 a piston in a side view, in full cross-section;

FIG. 2 an enlarged representation of the view Z of FIG. 1;

FIG. 3 a top view of the oil guide ring according to the invention;

FIG. 4 a cross-section of the oil guide ring;

FIG. 5 a developed view of the oil guide ring.

A piston 1 has a cooling channel 2 provided at the height of the ring belt, which channel is closed off, at its end that is open towards the piston skirt, by means of a two-part spring part 8, which possesses an opening that serves as the cooling oil inlet 5. An oil guide ring 3 that runs around the periphery, and is provided on its circumference with a cooling oil inlet, also referred to as 5, and a cooling oil outlet 6, is disposed in the cooling channel 2 in such a manner that it is supported on the spring part 8 and, with its outer wall part, on a recess 10, as shown in FIG. 2. The cooling oil inlet 5 and the cooling oil outlet 6 of the oil guide ring 3 lie opposite one another on the circumference. As a result of the axial spring effect of the spring part 8, the oil guide ring 3 is fixed in place in the cooling channel, whereby a radial alignment of the opening 5 of the spring part 8 and of the oil guide ring 3 is necessary during assembly, to make the cooling oil inlets coincide. In this assembly position, the cooling oil outlet 6 coincides with a cooling oil drain 6.1, which guides the oil into the interior of the piston. As an alternative, the oil guide ring, which consists of a light metal, such as aluminum, or of a temperature-resistant plastic, can be glued or screwed onto at least part of the two-part spring part 8. The support of the spring part 8 in the piston 1 is provided in known manner, for example by providing a support surface for the inner circumference and a corresponding collar-like recess for the outer circumference of the spring part 8. The spring part is divided into two halves by means of radial divisions, which halves form the lower end of the cooling channel 8, under bias.

The oil guide ring 3 has steps 9, symmetrically distributed over its circumference, between the cooling oil inlet and the cooling oil outlet, which steps form sections 4 between the steps, in each instance, which sections are disposed axially in the cooling channel 2, at different heights. Starting from the cooling oil inlet 5, the first section 4.1 or 4.1' possesses the smallest volume, with reference to the total cooling channel volume, i.e. step 9 has a height h that corresponds to approximately 60 percent of the cooling channel height. Each of the subsequent steps of the sections 4.2 to 4.4, or 4.2' to 4.4', increase in size by approximately another 10 percent in height with reference to the first section. The distribution of the steps 9, and therefore the number, is defined by means of different arc angles $\alpha$, $\beta$, $\gamma$, $\delta$ (in the clockwise direction, according to FIG. 3) and $\alpha'$, $\beta'$, $\gamma'$, $\delta'$ (in the counterclockwise direction, according to FIG. 3), the rise of which increases in linear manner, starting from the cooling oil inlet 5 to the cooling oil outlet 6. In the exemplary embodiment according to FIG. 3, $\alpha=\alpha'=30$ arc degrees, $\beta=\beta'=40$ arc degrees, $\gamma=\gamma'=50$ arc degrees, and $\delta=\delta'=60$ arc degrees, i.e. the cooling oil stream 7 that flows between the cooling oil inlet 5 and the cooling oil outlet 6 absorbs approximately the same amount of heat, as a result of the wall contact, in location-dependent manner, as a result of the flat incline of the surfaces between the stages. As a result of this design embodiment, the result is advantageously achieved that the cold cooling oil in the first section 4 absorbs a great amount of heat because of the direct contact with the hot wall surfaces, even without the shaker effect. The further absorption of heat is reduced by means of the section-by-section increase in the cooling channel volume, whereby the heat transition is now achieved only by means of the effect of the shaker, as a result of the stroke movements of the piston. In the exemplary embodiment, the cross-section of the first sections 4.1/4.1' of the cooling channel, which has a size of 28 $mm^2$, increases to 198 $mm^2$ in the fourth sections 4.4/4.4'. In total, there is therefore a better heat distribution, particularly at the ring belt and at the bowl edge of the piston.

| Reference Symbols | |
|---|---|
| Piston | 1 |
| Cooling channel | 2 |
| Oil guide ring | 3 |
| Section | 4 |
| First section | 4.1/4.1' |
| Second section | 4.2/4.2' |
| Third section | 4.3/4.3' |
| Fourth section | 4.4/4.4' |
| Cooling oil inlet | 5 |
| Cooling oil outlet | 6 |
| Cooling oil drain | 6.1 |
| Cooling oil | 7 |
| Spring part | 8 |
| Steps | 9 |
| Recess | 10 |
| Arc angle of the sections | $\alpha$, $\beta$, $\gamma$, $\delta$, $\alpha'$, $\beta'$, $\gamma'$, $\delta'$ |

The invention claimed is:

1. Cooled piston for an internal combustion engine, having a cooling channel that runs around the piston head in ring shape at the height of the ring belt, which channel is closed off, at its end that is open towards the piston skirt, by means of a spring part that is appropriately shaped and provided with a cooling oil inlet and a cooling oil outlet, and is radially divided at least once on its circumference, characterized in that an oil guide ring (3) that runs around the periphery is disposed in the cooling channel (2), and divides the cooling channel, on the circumference side, into sections (4) having different cooling channel volumes, symmetrically from the cooling oil inlet (5) to the cooling oil outlet (6).

2. Cooled piston for an internal combustion engine, as recited in claim 1, characterized in that the sections (4) are formed on the circumference side by means of steps (9) molded into the oil guide ring (3), whereby each step (9), starting from the cooling oil inlet (5) to the cooling oil outlet (6), increases the cooling channel volume by a percentage, relative to the total cooling channel volume.

3. Cooled piston for an internal combustion engine, as recited in claim 1, characterized in that the ring-shaped sections (4) are defined by an arc angle whose incline increases, in linear manner, from the cooling oil inlet (5) to the cooling oil outlet (6).

4. Cooled piston for an internal combustion engine, as recited in claim 3, characterized in that the incline for each section amounts to 10 arc degrees.

5. Cooled piston for an internal combustion engine, as recited in claim 1, characterized in that the cooling oil inlet (5) and the cooling oil outlet (6) are disposed opposite one another in the cooling channel (2), and that the first section (4.1) from the cooling oil inlet (5) is formed by an arc angle of 30 degrees.

6. Cooled piston for an internal combustion engine, as recited in claim 1, characterized in that the oil guide ring (3) is fixed in place on at least one of the spring parts (8).

7. Internal combustion engine as recited in claim 1, characterized in that the oil guide ring (3) consists of aluminum or plastic.

* * * * *